US005373939A

United States Patent [19]

Bloomgren

[11] Patent Number: 5,373,939

[45] Date of Patent: Dec. 20, 1994

[54] MECHANIC'S BOLT AND SMALL PARTS RECEPTACLE

[76] Inventor: Ellis R. Bloomgren, 2309 W. 17th St., Loveland, Colo. 80538

[21] Appl. No.: 189,791

[22] Filed: Feb. 1, 1994

[51] Int. Cl.[5] ..... B65D 85/20

[52] U.S. Cl. ..... 206/341; 206/373; 206/443; 211/70.1; 211/70.6

[58] Field of Search ..... 211/70.6, 70.1; 206/366, 372, 373, 489, 379, 234, 382, 341, 443, 338

[56] References Cited

U.S. PATENT DOCUMENTS

| | | | |
|---|---|---|---|
| 3,263,820 | 8/1966 | McFadden et al. | 211/70.1 X |
| 4,138,055 | 2/1979 | Harrison . | |
| 4,267,995 | 5/1981 | McMillan . | |
| 4,412,618 | 11/1983 | La Conte | 206/373 X |
| 4,644,610 | 2/1987 | Fish . | |
| 4,760,624 | 8/1988 | Fish . | |
| 4,815,593 | 3/1989 | Brown | 206/373 X |
| 4,890,734 | 1/1990 | Gach | 206/366 |
| 5,147,038 | 9/1992 | Pergeau | 206/373 |
| 5,205,530 | 4/1993 | Fish . | |

*Primary Examiner*—Jacob K. Ackun, Jr.
*Attorney, Agent, or Firm*—William E. Hein

[57] ABSTRACT

A mechanic's bolt and small parts receptacle for storing bolts, screws, and other small parts removed during repair of an engine or other machine is formed of cardboard as a polyhedron that includes a sloping front panel having a plurality of perforations thereon for receiving and storing individual bolts and screws and that also includes an internal cavity accessible through an opening in a sloping rear panel for storing other small parts.

4 Claims, 1 Drawing Sheet

MECHANIC'S BOLT AND SMALL PARTS RECEPTACLE

BACKGROUND AND SUMMARY OF THE INVENTION

This invention relates generally to holders and receptacles and more particularly to a receptacle specifically adapted for the orderly retention of bolts, screws, and other small parts as they are removed from internal combustion engines and other machinery during disassembly for repair or overhaul. In the past, it has been common practice, during disassembly of an engine or other machine, for mechanics to randomly place bolts, screws, and miscellaneous small parts into boxes, jars or cans for storage until such time as it is desired to reassemble the machine. If such containers are not available at the time, mechanics have been known to place removed parts on the floor, the workbench or even on the machinery itself. This practice has led to wasted time in relocating specific bolts, screws, and other small parts required at a particular time during the reassembly process, as well as to loss of parts through inadvertent scattering and misplacement.

A number of holders for various items are known in the prior art. For example, U.S. Pat. No. 4,138,055 to Harrison is directed to a holder for newspapers and other periodicals adapted for attachment to a mailbox post. U.S. Pat. No. 4,267,995 to McMillan is directed to a holder for holding a bundle of wires together. U.S. Pat. No. 4,644,610 to Fish is directed to a disc-shaped holder that can be incorporated into a variety of bodies for holding tools, separating wires, etc. U.S. Pat. No. 4,760,624 to Fish is directed to a closer/holder for plastic bags. U.S. Pat. No. 5,205,530 to Fish is directed to an apparatus and method for dispensing radially slitted holders.

It is therefore a principal object of the present invention to provide an inexpensive receptacle for storing bolts, screws, and other small parts removed during repair of an engine or other machine, in which those items are stored in a segregated, organized arrangement so that they are individually readily accessible by the mechanic at the time of reassembly of the machine.

This and other incidental objects are accomplished in accordance with the illustrated preferred embodiment of the present invention by providing a cardboard polyhedron that includes a sloping front panel having a plurality of perforations thereon for receiving and storing individual bolts and screws and that further includes an internal cavity accessible through an opening in a slightly inwardly sloping rear panel for storing other small parts.

DETAILED DESCRIPTION OF THE PREFERRED EMBODIMENT

Figure 1:
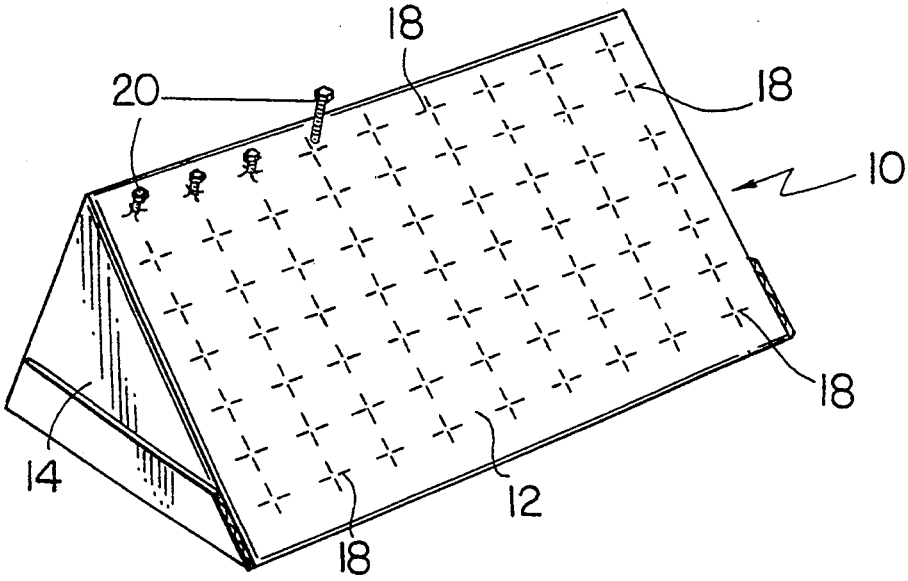
FIG. 1 is a front pictorial illustration of a mechanic's bolt and small parts receptacle constructed in accordance with the present invention.
Figure 2:
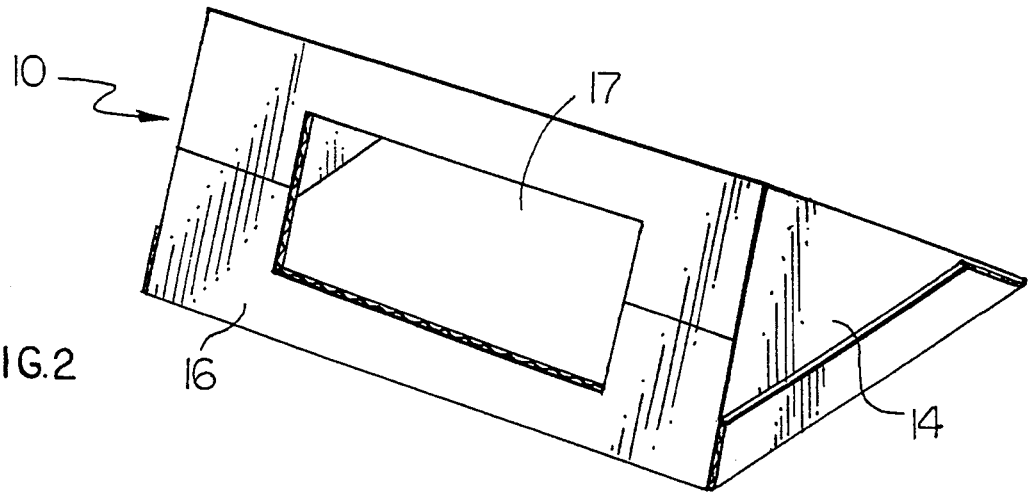
FIG. 2 is a rear pictorial illustration of the mechanic's bolt and small parts receptacle of FIG. 1 showing an internal cavity for storing small parts and an access opening therefor.
Figure 3:
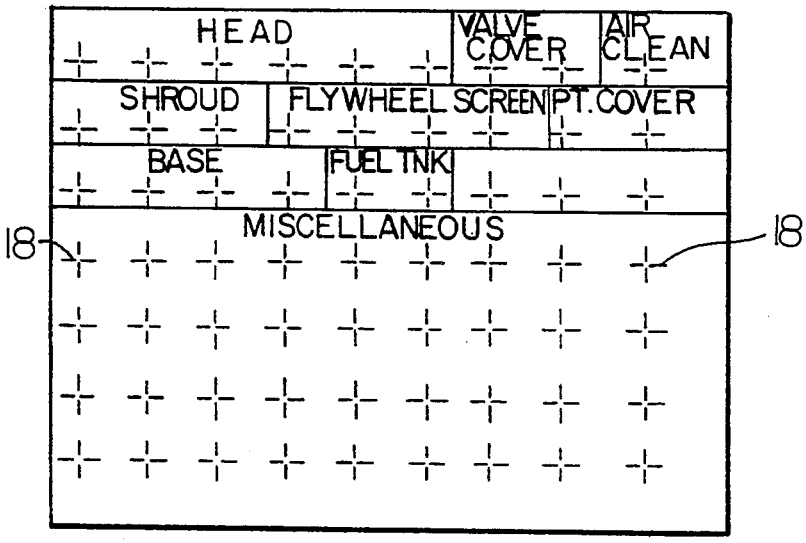
FIG. 3 is a plan view of a front panel of the mechanic's bolt and small parts receptacle of FIG. 1 and 2 illustrating bolt and screw identification indicia that may be printed thereon.

Referring now to the drawings, there is shown a mechanic's bolt and small parts receptacle 10 that is preferably formed of cardboard in the shape of a polyhedron having an upwardly and inwardly sloping front panel 12, vertical left and right side panels 14, an upwardly and slightly inwardly sloping rear panel 16, and a flat bottom panel 17. Receptacle 10 may be conveniently fabricated by folding a pre-shaped flat sheet of cardboard. Overlapping folds may be fastened together by any of a number of well known techniques employing glue, staples, tabs or plastic ties, for example. Front panel 12 of receptacle 10 includes a matrix of spaced rows and columns of perforations 18 into which various screws and bolts 20 may be inserted for storage. The perforations 18 provide frictional retention of screws and bolts 20 of varying diameter. Sloping front panel 12 facilitates storage of bolts of varying length, as well. Front panel 12 may include identification indicia associated with selected ones of the perforations 18, as illustrated in FIG. 3, to facilitate organization of the bolts and screws 20 that are stored thereon. The identification indicia may be provided by the mechanic at the time of disassembly of an engine or other machine or may be pre-printed on those receptacles 10 that are customized for use in connection with repair of specific engines, for example. An opening is provided in rear panel 16 to permit access to the interior of receptacle 10 for storage and removal of miscellaneous small parts other than the bolts and screws 20 that are stored on front panel 12.

Since engines and other machines being repaired vary in size and complexity of bolts and other parts, receptacle 10 may be sized accordingly.

I claim:

1. A receptacle for providing organized storage of bolts, screws, and miscellaneous small parts removed from a machine during repair thereof, the receptacle comprising a cardboard polyhedron having a rectangular, horizontally positioned bottom panel, a flat front panel that slopes upwardly and rearwardly from a front edge of said bottom panel, a flat rear panel that slopes upwardly and forwardly from a rear edge of said bottom panel, and left and right side panels, the front panel having a matrix of spaced expandable perforations cut directly therein, into each of which a bolt or screw may be inserted for storage, the rear panel including an opening to permit access by a user to an interior cavity of the receptacle for storage and removal of miscellaneous small parts other than the bolts and screws that are stored on the front panel.

2. A receptacle as in claim 1 wherein said left and right side panels are vertical.

3. A receptacle as in claim 1 wherein said matrix of spaced perforations comprises evenly spaced rows and columns thereof.

4. A receptacle as in claim 1 wherein said front panel includes pre-printed parts indentification indicia associated with groups of said perforations.

* * * * *